US006736203B2

(12) United States Patent
Rhodes et al.

(10) Patent No.: US 6,736,203 B2
(45) Date of Patent: May 18, 2004

(54) HEAT EXCHANGER HEADER AND TANK UNIT

(75) Inventors: Eugene E. Rhodes, Belleville, MI (US); Wen Fei Yu, Ann Arbor, MI (US); Gregory A. Whitlow, Whitmore Lake, MI (US); Keith E. Liederman, Brighton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/846,941

(22) Filed: Apr. 30, 2001

(65) Prior Publication Data

US 2002/0157814 A1 Oct. 31, 2002

(51) Int. Cl.[7] ..... F28D 7/06
(52) U.S. Cl. ..... 165/176; 165/175; 165/173
(58) Field of Search ..... 165/140, 176, 165/178, 174, 173, 175

(56) References Cited

U.S. PATENT DOCUMENTS

| | | | | |
|---|---|---|---|---|
| 3,368,617 A | * | 2/1968 | Rosman et al. | 165/175 |
| 4,492,267 A | | 1/1985 | Cadars | |
| 4,770,240 A | * | 9/1988 | Dawson et al. | 165/176 |
| 5,163,507 A | | 11/1992 | Joshi | |
| 5,163,509 A | * | 11/1992 | Dawson | 165/176 |
| 5,186,243 A | * | 2/1993 | Halstead | 165/135 |
| 5,186,244 A | * | 2/1993 | Joshi | 165/135 |
| 5,186,246 A | | 2/1993 | Halstead | |
| 5,190,101 A | * | 3/1993 | Jalilevand et al. | 165/176 |
| 5,445,219 A | | 8/1995 | Hutto et al. | |
| 5,743,328 A | * | 4/1998 | Sasaki et al. | 165/144 |
| 6,189,603 B1 | * | 2/2001 | Sugimoto et al. | 165/140 |
| 6,216,777 B1 | * | 4/2001 | Rhodes et al. | 165/176 |
| 6,272,881 B1 | * | 8/2001 | Kuroyanagi et al. | 62/525 |
| 6,364,005 B1 | * | 4/2002 | Makino et al. | 165/140 |
| 6,494,254 B2 | * | 12/2002 | Laveran | 165/133 |

FOREIGN PATENT DOCUMENTS

| | | |
|---|---|---|
| EP | 0 855 566 A2 | 7/1998 |
| JP | 62-94796 | 5/1987 |
| JP | 6-50675 | 2/1994 |
| JP | 10 019490 | 1/1998 |
| JP | 10 132473 | 5/1998 |

OTHER PUBLICATIONS

Combined Search and Examination Report, dated Sep. 27, 2002, for corresponding British Patent Application No. GB 0207789.9.

* cited by examiner

*Primary Examiner*—Henry Bennett
*Assistant Examiner*—Nihir Patel
(74) *Attorney, Agent, or Firm*—Brinks Hofer Gilson & Lione

(57) ABSTRACT

An apparatus is disclosed for supporting and sealing a heat exchanger unit. Specifically, a unitary header and tank unit is disclosed comprising a condenser header and tank unit arranged in parallel relation to a radiator header and tank unit. The unitary header and tank unit is formed from a single piece of stamped material. The single piece of material is stamped to include a perpendicular extrusion and two base portions, each base portion being perforated. The partial separation of the perpendicular extrusion into two flange portions allows the base portions to be folded over onto the flange portions thereby forming two header and tank units with a single internal partition. Additionally, a fin unit is disclosed that is capable of traversing the heat exchange fins of multiple heat exchangers.

5 Claims, 2 Drawing Sheets

HEAT EXCHANGER HEADER AND TANK UNIT

FIELD OF THE INVENTION

The present invention relates to heat exchangers. In particular, the invention relates to a unitary header and tank structure including of a condenser header and tank unit arranged in parallel relation to a radiator header and tank unit.

BACKGROUND OF THE INVENTION

Heat exchangers are utilized in conventional automobiles to dissipate heat from the engine, or to provide heat exchange to the interior of the car such as with air-conditioning. Typically, two heat exchangers accomplish the task of cooling the engine and cooling the internal occupancy space of the automobile: a radiator and a condenser. These automotive components are positioned in front of a cooling fan and behind the intake grill. While typically located in close proximity to one another, the radiator and condenser are separate, autonomous units.

As currently produced, radiators and condensers are two separate components. Radiators and condensers may also be linked together structurally by affixing the components together so as to serve as one component. Most often, in these configurations, the headers and tanks from the condenser and radiator are affixed to one another at the inner walls of each of said units. The process of forming a combination radiator and condenser apparatus further includes closing the ends of the hollow members (tanks) and piercing holes in the bases of the respective header units. Heat transfer tubes can then be positioned to align with the holes pierced in the headers. The two header and tank members are then sealed by covering the different components in a cladding material and then brazing the unit to form the combination radiator and condenser unit.

Thus, the manufacture of a combination heat exchanger is a complex process that involves affixing two separate heat exchangers to one another to form a single, cohesive unit.

Another aspect of the current invention relates to the fins that serve to dissipate heat from the heat transfer tubes. As currently produced, each heat exchanger utilizes its own heat transfer fins with two separate fin units.

SUMMARY OF THE INVENTION

The present invention relates to a unitary header and tank unit comprising a condenser header and tank unit arranged in parallel relation to a radiator header and tank unit. By having a heat exchanger configured in this fashion, space is saved in the engine compartment. Additionally, by utilizing the disclosed methodology for manufacturing a unitary header and tank unit, manufacturing costs are substantially reduced. The present invention also provides improved overall structural integrity.

In one embodiment of the present invention, a unitary header and tank unit is disclosed comprising a condenser header and tank unit arranged in parallel relation to a radiator header and tank unit. This unitary header and tank unit is formed from a single piece of material. The radiator header and tank unit and condenser header and tank unit maintain separate heat exchange fluid flowpaths. A plurality of parallel heat transfer tubes is connected perpendicularly to each said header and tank units, and a plurality of fins extend between adjacent heat transfer tubes of the heat exchangers.

In another embodiment of the invention, a fin unit that traverses the heat transfer tubes of both heat exchangers is disclosed.

BRIEF DESCRIPTION OF THE DRAWINGS

These and other features of the invention will appear from the following written description, and from the drawings, in which.

DESCRIPTION OF THE PREFERRED EMBODIMENT

Figure 1:
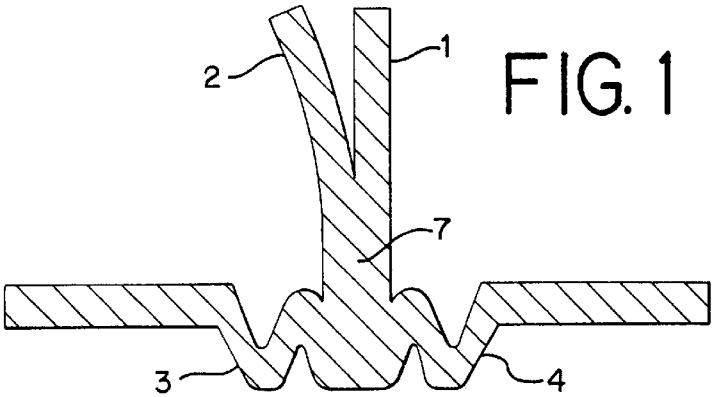
FIG. 1 is a cross-sectional view of the single piece of stamped material used to form the unitary header and tank unit.
Figure 4:
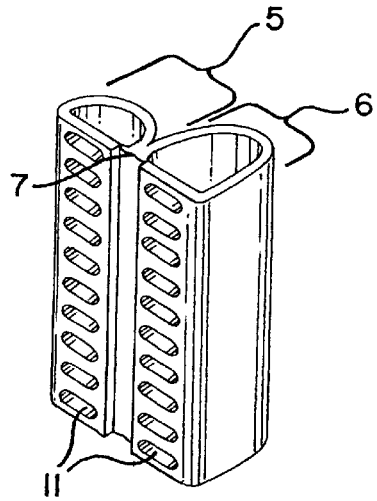
FIG. 4 is a perspective view of the unitary header and tank unit—with the condenser header and tank unit located in parallel relation to the radiator header and tank unit—removed from the full embodiment of FIG. 3.

FIG. 1 shows a cross-sectional view of the single piece stamping that forms the preferred condenser header and tank unit and the radiator header and tank unit. As shown in the drawing, the single piece of aluminum material is partially separated along its vertical extrusion to form two flange portions 1, 2. The single piece of material further includes two base portions 3, 4 that serve as the headers to the heat exchanger units. These base portions 3, 4 are stamped with perforations 11 (as shown in FIG. 4) that coincide with heat transfer tubes 12, 13 of a heat exchanger. These perforations 11 are of an extended oval shape in the preferred embodiment but could be shaped in any way that would coincide to the heat transfer tubes 12, 13 of a heat exchanger. The base portions 3, 4, which serve as the headers of the heat exchanger units, are folded up onto the flange portions 1, 2 to create two header and tank units 5, 6 with a common internal partition 7. After the base portions 3, 4 are folded up onto the flange portions 1, 2, the united edges are brazed to seal the unitary header and tank unit. Although a variety of dimensions could be used, depending on the malleability of the material being used, the internal partition 7 of the preferred embodiment has a thickness of 1.0 to 1.8 millimeters. In utilizing an aluminum material in the manufacturing process, it is found that this is the desired range for allowing the various parts of the single piece stamping to be folded into the proper form. While not depicted in the drawings, the ends of the header and tank units 5, 6 can be sealed by affixing an end cap, such as that shown in co-pending application Ser. No. 09/753,293, onto the header and tank units 5, 6. It is also noted that the outer ends of each tank unit formed from the single piece of material can be pinched together on each open end through traditional mechanical methods so as to seal the tank units.

Figure 2:
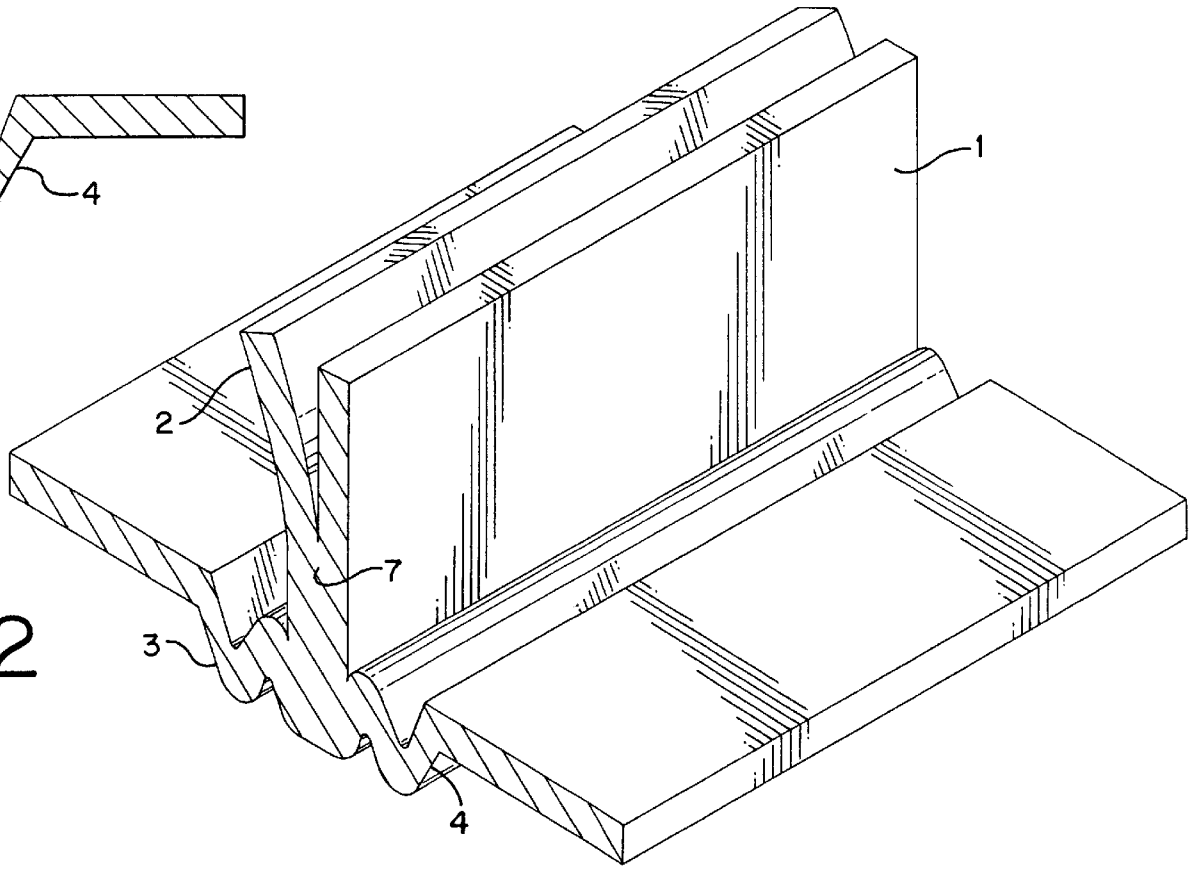
FIG. 2 is a side view of the single piece of stamped material used to form the unitary header and tank unit.

FIG. 2 shows a side view of the single piece stamping that forms the preferred unitary header and tank unit. From this drawing one can see that if the base portions 3, 4 are folded up onto the flange portions 1, 2, two tanks are formed and a unitary header and tank structure results. This drawing also shows the common internal partition 7 that remains when the base portions 3, 4 are folded up onto the flange portions 1, 2. The internal partition 7 results from the "un-flanged" portion of the single piece of material that vertically extrudes from the bases 3, 4. The dimensions with respect to the length of the single piece of aluminum stamped material will vary in accordance with the desired dimensions of the specific heat exchanger to be manufactured.

Figure 3:
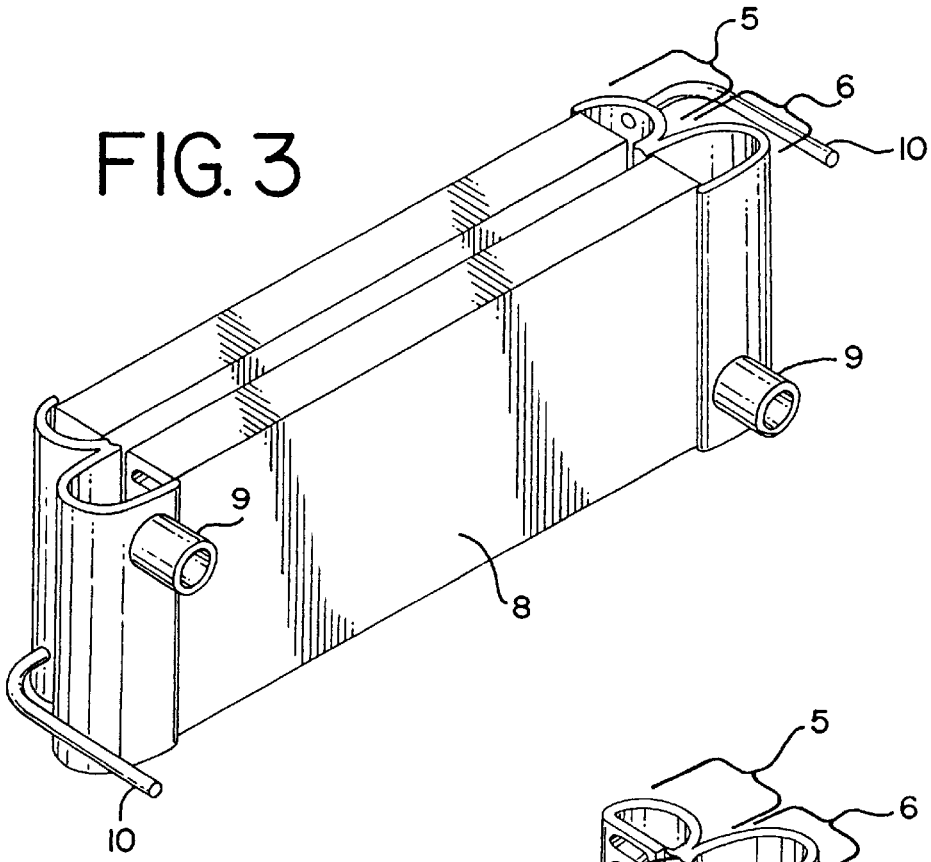
FIG. 3 is a perspective of one embodiment of a heat exchanger assembly utilizing the unitary header and tank unit.

FIG. 3 shows a perspective view of a heat exchanger unit with the preferred embodiment incorporated therein. As can be seen in the drawing, the condenser and radiator header and tank units 5, 6 are affixed to the heat exchanger core 8 which is comprised of heat transfer tubes 12, 13 as well as a plurality of fin units used to dissipate heat. FIG. 3 further shows the full relationship of two unitary header and tank units 5, 6 located at opposite ends of the heat exchanger core 8, as they would be in a traditional heat exchanger configuration. FIG. 3 also shows inlet and outlet pipes that are affixed to the header and tank units 5, 6. These inlet and outlet pipes 9, 10 are affixed to the header and tank units 5, 6 by perforating the tank and header units to correspond with the desired pipe size and then brazing the inlet and outlet pipes 9, 10 to the header and tank units 5, 6.

FIG. 4 is a perspective view of the first preferred embodiment of the present invention as viewed when separated from the other components illustrated in FIG. 3. In addition to showing the condenser header and tank unit 5 arranged in parallel relation to the radiator header and tank unit 6, this drawing clearly shows the perforations 11 that are stamped in the base 3, 4 of the condenser 5 and radiator 6 header units. These perforations 11 are stamped in the base portion 3, 4 of the single piece of material that is used to form the unitary header and tank unit. These perforations 11 coincide with, and are affixed to, heat transfer tubes 12, 13 of the condenser unit 5 and the radiator unit 6. The common inner wall 7 between the condenser header and tank unit 5 and the radiator header and tank unit 6 can also be seen in this drawing.

Figure 5:
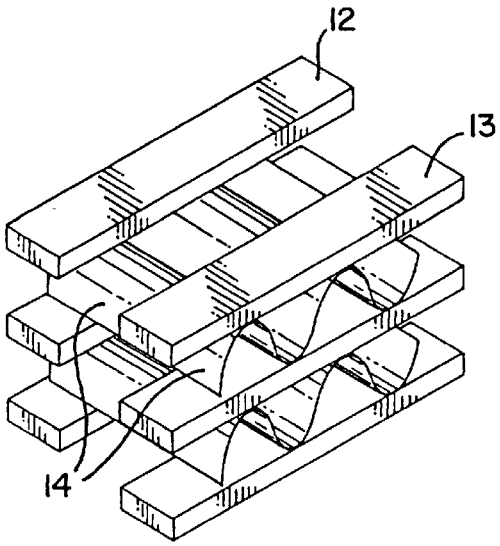
FIG. 5 is a sectional view of the fin unit capable of traversing both of the heat transfer tubes of the two heat exchangers.

FIG. 5 is a cutaway view of the common fin unit 14. As shown in the drawing, the fin unit 14 traverses heat transfer tubes that are affixed to the both the condenser 5 header and tank unit and the heat transfer tubes that are affixed to the radiator 6 header and tank unit. Referring back to FIG. 3 will offer perspective as to the positioning of the heat transfer tubes as they would extend in a longitudinal manner between the header units 5, 6 located on opposite ends of the heat exchanger core 8. Thus, FIG. 5 shows the cutaway view of a common fin unit 14 that would dissipate heat from the heat transfer tubes of both a radiator unit 6 and a condenser unit 5. The traditional use of fin units where each heat exchanger unit would utilize its own fin units could also be used in the present invention.

Of course, it should be understood that a wide range of changes and modifications can be made to the preferred embodiments described above. Thus, it is intended that the foregoing detailed description be regarded as illustrative rather than limiting, and that it be understood that it is the following claims, including all equivalents, which are intended to define the scope of this invention.

What is claimed is:

1. A unitary header and tank structure comprising:

A condenser header and tank unit arranged in parallel relation, and adjacent to, a radiator header and tank unit, said condenser header and tank unit and radiator header and tank unit defining separate fluid flowpaths, said condenser header and tank unit and said radiator header and tank unit at least partially defined by a common internal partition formed from a single piece of material, said single piece of material being partially separated to form at least two flange portions, each flange portion being folded over to form a unitary header and tank unit with a common internal partition; and said single piece of material capable of being pinched together to seal the header and tank units.

2. The unitary header and tank structure of claim 1, wherein said condenser header and tank unit further comprises a plurality of perforations in base of condenser header unit, each perforation capable of being brazed or affixed to a heat transfer tube.

3. The unitary header and tank structure of claim 1, wherein said radiator header and tank unit further comprises a plurality of perforations in base of radiator header unit, each perforation capable of being brazed or affixed to a heat transfer tube.

4. The unitary header and tank structure of claim 1, wherein said common internal partition is between 1.0 and 1.8 millimeters in thickness.

5. A unitary header and tank structure comprising:

a condenser header and tank unit arranged in parallel relation, and adjacent to, a radiator header and tank unit, said condenser header and tank unit and said radiator header and tank unit defining separate fluid flowpaths;

said unitary tank and header unit being formed from a one-piece stamping of aluminum material, said one-piece stamping of aluminum material being partially separated to provide for two flange portions, said one-piece stamping of aluminum material further comprised of perforations in base portions of said stamping, wherein said base portions are folded up onto said flange portions of stamping to provide a condenser header and tank unit and a radiator header and tank unit;

said one-piece stamping of aluminum material being capable of having ends pinched so as to seal said condenser header and tank unit and said radiator header and tank unit.

* * * * *